US005762759A

United States Patent [19]

Wedel

[11] Patent Number: 5,762,759

[45] Date of Patent: Jun. 9, 1998

[54] TAIL THREADING SYSTEM FOR A PAPERMAKING MACHINE

[75] Inventor: Gregory L. Wedel, Beloit, Wis.

[73] Assignee: Beloit Technologies, Inc., Wilmington, Del.

[21] Appl. No.: 787,346

[22] Filed: Jan. 27, 1997

[51] Int. Cl.[6] ..... D21F 1/36; D21F 7/00

[52] U.S. Cl. ..... 162/193; 162/194; 162/255; 162/286; 34/117; 83/53; 83/177; 226/7; 226/91

[58] Field of Search ..... 162/280, 281, 162/306, 193, 194, 286, 255; 34/120, 121, 722, 117; 83/53, 177; 226/97, 91, 95

[56] References Cited

U.S. PATENT DOCUMENTS

| | | | |
|---|---|---|---|
| 3,999,696 | 12/1976 | Reba et al. | 226/7 |
| 4,445,646 | 5/1984 | Karr et al. | 242/521 |
| 4,684,443 | 8/1987 | Kerttula et al. | 162/255 |
| 4,692,215 | 9/1987 | Kerttula | 162/289 |
| 4,815,220 | 3/1989 | Wedel | 34/120 |
| 4,874,470 | 10/1989 | Skaugen | 162/360.1 |
| 4,904,344 | 2/1990 | Peiffer | 162/193 |
| 4,931,140 | 6/1990 | Peltola et al. | 162/193 |
| 4,945,655 | 8/1990 | Wedel | 34/23 |
| 5,087,325 | 2/1992 | Page | 162/193 |
| 5,158,648 | 10/1992 | Weldon | 162/193 |
| 5,232,554 | 8/1993 | Kotitschke | 162/193 |
| 5,281,308 | 1/1994 | Lauterbach | 162/306 |
| 5,522,151 | 6/1996 | Deshpande et al. | 34/114 |
| 5,600,897 | 2/1997 | Sollinger et al. | 34/115 |

FOREIGN PATENT DOCUMENTS

| | | |
|---|---|---|
| 63-66393 | 9/1986 | Japan . |
| WO 91/03359 | 3/1991 | WIPO . |

*Primary Examiner*—Donald E. Czaja
*Assistant Examiner*—Jose S. Fortuna
*Attorney, Agent, or Firm*—Lathrop & Clark

[57] ABSTRACT

A papermaking machine uses a low pressure water jet mounted on a pneumatic actuator for movement at least as fast in the cross machine direction as the paper web moves in the machine direction for a distance of 2 to 12 inches. The jet rapidly cuts a tail with a blunt edge of 2 to 12 inches wide from the web. The actuator is mounted on a screw or belt driven carriage to traverse the web and expand the tail after it has been threaded through the dryer section until the tail encompass the entire web and thus completes the threading process. A controller coordinates an air jet positioned beneath a doctor blade and a vacuum suction roll which engages the last press roll. The air jet and vacuum suction roll are actuated when the blunt end of the tail engages the doctor blade. In this way a tail with little or no streamer is formed and blown onto a dryer fabric supported on a vacuum suction roll which leads the tail into a single tier dryer section.

23 Claims, 3 Drawing Sheets

TAIL THREADING SYSTEM FOR A PAPERMAKING MACHINE

FIELD OF THE INVENTION

The present invention relates to papermaking machines in general, and to an apparatus and method for threading a tail through a dryer section of a papermaking machine in particular.

BACKGROUND OF THE INVENTION

Paper in general and lightweight paper grades, such as newsprint, and lightweight coated paper, in particular, are manufactured by first forming a wet paper web on a forming wire or fabric. The formed web is then passed through a pressing section. Following the pressing section, the web is dried on a series of steam-heated drying cylinders.

The lightweight grades of paper are manufactured at high speeds. The high speed of manufacture reduces the cost of manufacturing the paper. Speeds of 3,000 to 5,000 feet per minute or more are commonly used. The manufacture of paper is a continuous process from the wet end where the web is formed to the reel where the formed paper is wound onto spools and removed from the papermaking machine.

The paper web as it is being formed is supported on a forming fabric which supports the web and transports the web. A pick-up felt is used to transfer the formed web from the forming section to a pressing section. The pressing section felt supports and aids in dewatering the formed web. The paper web as it is formed on the forming fabric is continuously conveyed as it moves through the forming section and is continuously supported as it moves through the pressing section. However, when the web leaves the last press roll, the web is dumped in a pit until it can be partially threaded into and through the dryer section. This is traditionally accomplished by cutting a narrow strip from the web and leading or pulling the narrow strip or "tail" through the dryer section. Once the tail has been threaded through the dryer section, the width of the tail is increased until the entire web of paper passes through the dryer section. In the past, threading a drying section has been a less than completely reliable process. The threading operation has typically employed pairs of ropes which entangle the web tail and thus hold the tail through the dryer section. Vacuum rolls and air jets are also used in some configurations to control the tail so as to cause it to move through the dryer section.

In a typical papermaking machine, breaks in the web occur, more or less frequently and, typically, in the dryer section. When a break occurs, the wet end continues to form the web which is scraped ("doctored") off the last press roll and recycled through a broke pit. Because paper is being recycled at the rate of up to 6,000 feet per minute, there is considerable economic advantage if the time during which the papermaking machine is being threaded can be minimized. One type of threading involves cutting a tail which is about 2 to 12 inches wide from the web while it is on the forming fabric. A relatively low pressure water jet of a few hundred psi is used to cut the tail from the formed web. When the web and the tail reach the doctor blade on the last press roll, they are both scraped off the press roll into the broke pit. A portion of the tail as it passes over the doctor blade can be blown by a jet of air onto a dryer felt, which is typically supported by a vacuum roll, which leads into the dryer section. The vacuum roll will typically have a narrow sector of the vacuum roll which is backed by a high vacuum suction gland for receiving the tail to initiate the threading process.

However, one problem with transferring the tail to the dryer section with this method is that the spent tail portion-which until the jet of air is actuated has been falling into the broke pit-is pulled out of the broke pit forming a "streamer" which follows the tail through the dryer section. Depending on the strength of the paper web being formed, the streamer can be 10 to 20 or more feet long. This streamer oftentimes becomes entangled on pipes, doctors, framing, air nozzles, and roller journals. When this happens, the threading process can be unsuccessful and may need to be re-initiated. Streamers which become entangled in the dryer section must be removed manually before the machine can resume operation.

Prior art attempts to cut the tail to prevent a streamer from being pulled into the dryer section have included using air jets directed against the portion of the tail which is hanging down into the broke pit. However air jets can only break the tail if it is of very low wet strength. High pressure water jets typically using water pressures of 30,000 to about 60,000 psi have also been employed with success, when the web is in the dryer section, but use of high pressure water jets has several practical difficulties. The high pressure water jets have very small nozzle diameters which are susceptible to plugging. In addition, the high pressure water jets must be protected against contact with machine operators. Placing a shield to reduce the hazard of the high pressure water jet is complicated by the need for visibility in the threading area. Furthermore, any shield positioned in the threading area can form an obstruction on which a streamer may become entangled.

What is needed is a threading method and apparatus which avoids the attachment of a streamer to the threading tail.

SUMMARY OF THE INVENTION

The present invention employs a low pressure water jet which is mounted on a pneumatic actuator with a piston which can move ideally at least as fast in the cross machine direction as the paper web moves in the machine direction for a distance of 2 to 12 inches. Thus the low pressure water jet cuts a tail of 2 to 12 inches wide from the paper web. The pneumatic actuator is mounted on a conventional screw or belt driven mechanism which traverses the width of the web. The pneumatic actuator allows a tail to be formed in the web with an identifiable beginning by rapidly moving the water jet from the edge of the web towards the center of the web to form the tail. The tail thus formed has a distinct beginning point defined by an edge which is ideally at most inclined forty-five degrees from a cross machine direction line. The screw mechanism is used to continue the traverse of the low pressure water jet across the web, after the tail has been threaded through the dryer section. Thus the screw mechanism widens the tail until it is as wide as the entire web and thus completes the threading process.

A controller coordinates an air jet positioned beneath a doctor blade on the last press roll. The air jet is actuated just before the beginning of the tail engages the doctor blade. In this way a tail with little or no streamer is formed and blown onto a dryer fabric supported on a vacuum roll which leads the tail into a single tier dryer section.

It is a feature of the present invention to provide a threading apparatus that both safely and efficiently threads a paper web through a papermaking machine.

It is another feature of the present invention to provide a method of cutting a tail in a paper machine that eliminates long streamers of spent tail.

It is a further feature of the present invention to provide a paper machine threading apparatus that eliminates the need for the use of threading ropes.

It is also a feature of the present invention to provide a dryer vacuum roll which engages the last press roll.

Further objects, features and advantages of the invention will be apparent from the following detailed description when taken in conjunction with the accompanying drawings.

DESCRIPTION OF THE PREFERRED EMBODIMENT

Figure 1:
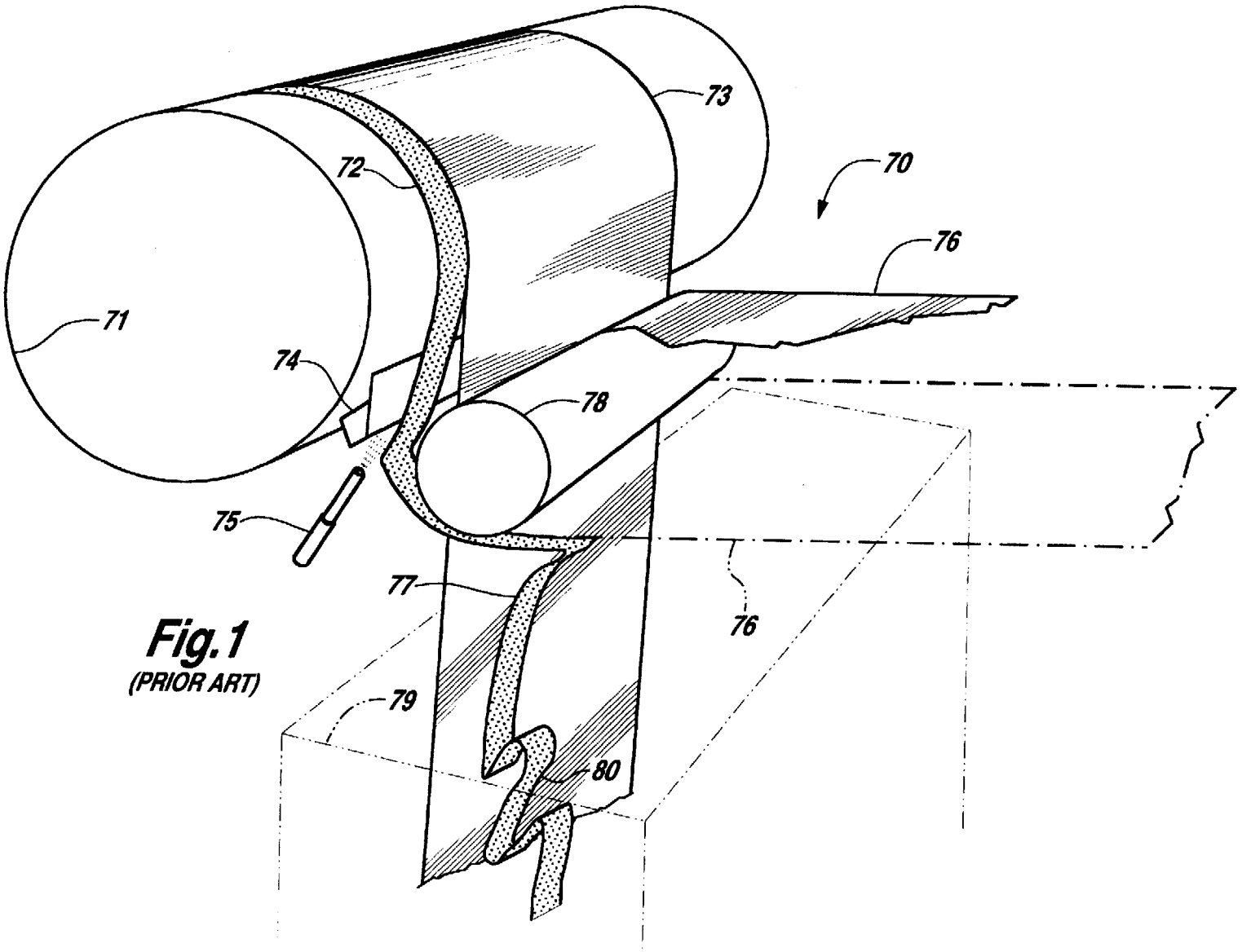
Fig. 1 (PRIOR ART)
FIG. 1 is an isometric view of a prior art papermaking machine illustrating how a streamer attached to a threading tail can be pulled out of a broke pit when the tail is threaded into a dryer section.
Figure 2:
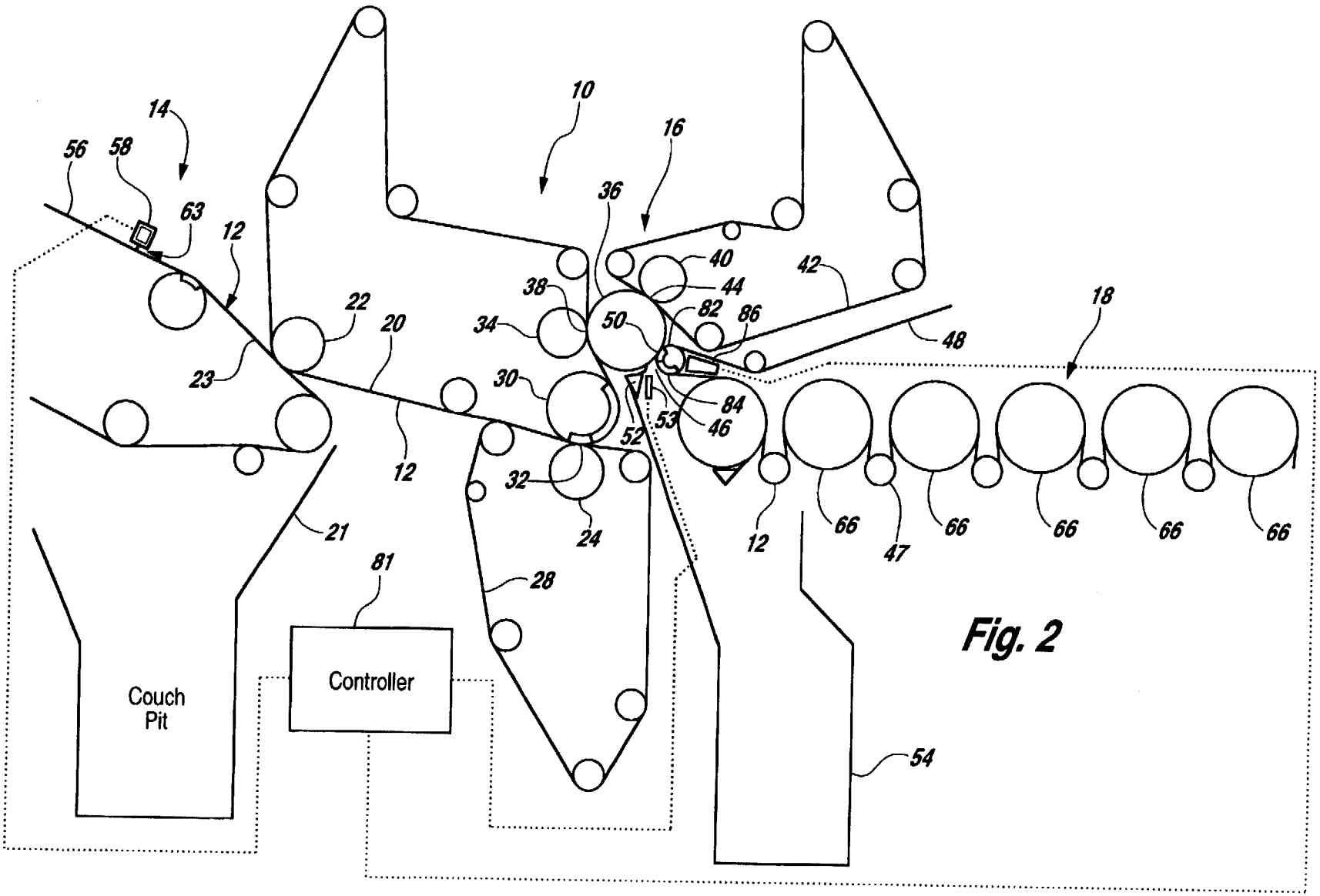
FIG. 2 is a schematic view of a paper web moving through a papermaking machine employing the threading apparatus of the present invention.
Figure 3:
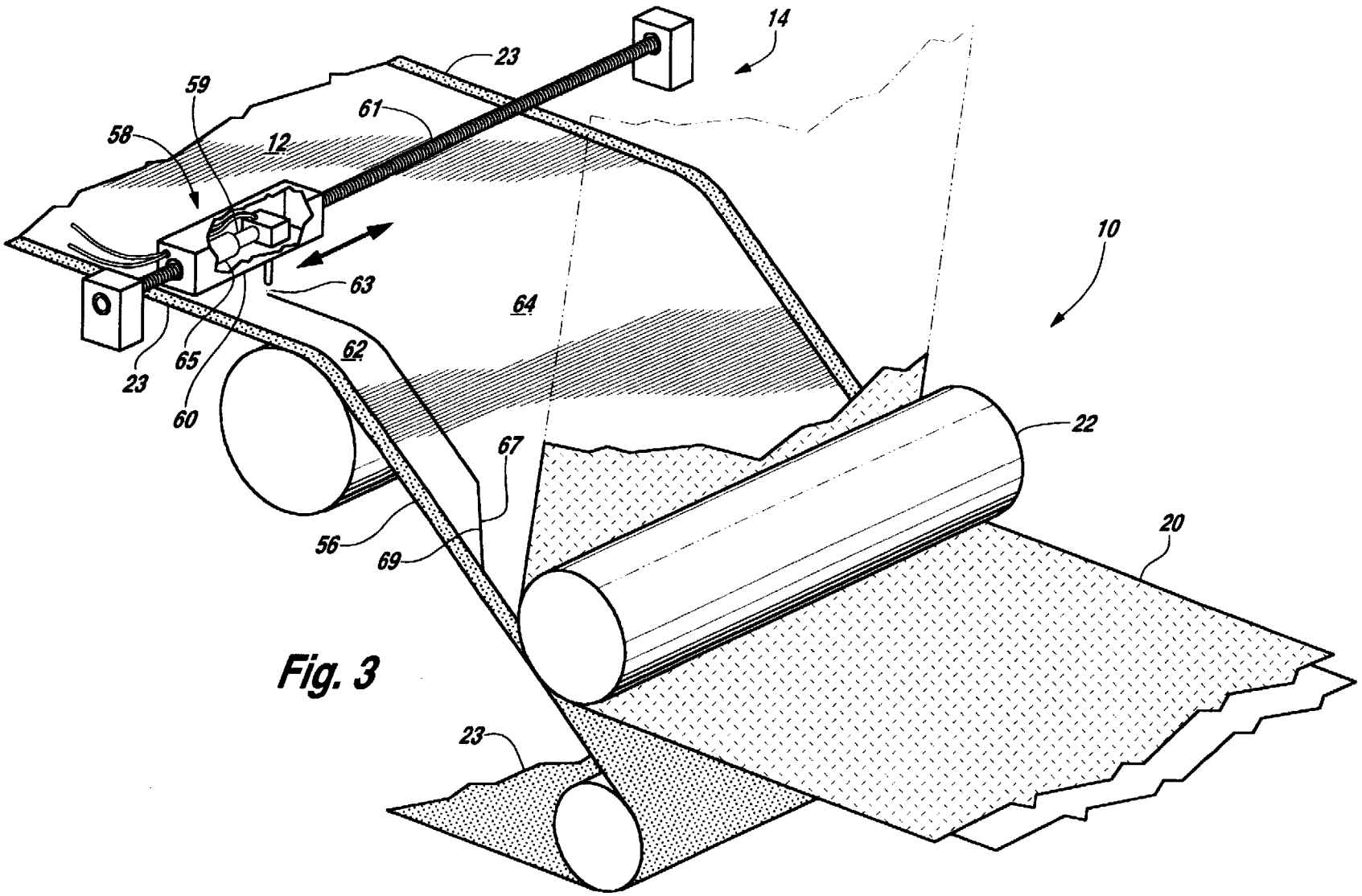
FIG. 3 is an isometric view of a paper web tail being cut using the method and apparatus of the present invention.

Referring more particularly to FIGS. 1–3 wherein like numbers refer to similar parts, in a papermaking machine 10, shown schematically in FIG. 2, a is paper web 12 moves from a wet end single-wire, top-wire, or twin-wire forming section 14, to a multi-nip roll press section 16 and into a single tier dryer section 18. A pick-up felt 20 located within the press section 16 forms a closed, endless loop extending around and guided by a suction pick-up roll 22. A couch pit 21 is positioned beneath the forming section 14. The suction pick-up roll 22 picks up the paper web 12 from a forming fabric 23 of the forming section 14. A first backing roll 24 is positioned within a second, closed, endless loop formed by a first press felt 28 within the press section 16. A suction press roll 30 is disposed within the endless loop formed by the pick-up felt 20 and is positioned opposite the first backing roll 24. The press roll 30 cooperates with the first backing roll 24 such that the pick-up felt 20 and the first press felt 28 extend through a first press nip 32 defined by the press roll 30 and the first backing roll 24.

A second backing roll 34 is located within the endless loop formed by the pick-up felt 20 and is positioned opposite a center press roll 36 such that the pick-up felt 20 extends through a second press nip 38 defined between the second backing roll 34 and the center press roll 36 located downstream from the first press nip 32. A third backing roll 40 is located within a closed endless loop formed by a second press felt 42. The third backing roll 40 is positioned opposite the center press roll 36 such that the second press felt 42 extends through a third press nip 44 downstream from the second press nip 38. The third press nip 44 is defined between the center press roll 36 and the third backing roll 40.

The dryer section 18 shown is a single-tier dryer section which is referred to as a BelRun dryer section, additional tiers of single tier dryers (not shown) may be used to form a dryer section known as a BelChamp™ dryer section and available from Beloit Corporation of Beloit, Wisconsin. The dryer section 18 is composed of dryer rolls 66 and reversing vacuum rolls 47.

A vacuum suction roll 46 is disposed within an endless loop formed by a dryer fabric 48. The vacuum suction roll 46 guides the dryer fabric 48 so that it extends through a contact nip 50 formed between the center press roll 36 and the vacuum suction roll 46. A doctoring blade 52 is positioned downstream from and below the contact nip 50. When the web is not fully threaded into the dryer section, the doctor blade 52 doctors the paper web 12 from the center press roll 36 and into a press broke pit 54.

In operation, the paper web 12 is formed on and travels along the forming fabric 23 in the forming section 14. A wet end tail cutter 58, shown in FIG. 3 is composed of a carriage 60 mounted on a cross feed screw 61. A low pressure water jet 63 is positioned at the front edge 56 of the forming fabric 23. A pneumatic actuator 65 is mounted on the carriage 60 and extends a piston 59 to rapidly traverse the tail cutter 58 in a cross machine direction at a rate of speed approximately equal to or greater than the velocity of the moving paper web 12, cutting the paper web 12 to form two ribbons. The first consisting of a tail 62 with a relatively blunt end 67 formed by a cut line 69 which is about forty-five degrees or more from the direction defined by motion of the web in the machine direction. The tail 62 has a cross machine direction width of about 2 to 2 inches. The second part consists of the remaining paper web 64. The pneumatic actuator 65 is preferably of the double acting type to allow both extension and retraction of the piston 59.

An example of a prior art tail cutting apparatus 70 in a papermaking machine is shown in FIG. 1. The water jet in the prior art apparatus 70 was simply mounted on a carriage which moved across the paper web on a screw or belt drive. Thus the speed of water jet movement was low compared to the velocity of the paper web in the machine direction. Thus prior art tail cutters are incapable of forming a tail with a distinct end. In the prior art machine 70, a paper web 73 travels over a press roll 71. The paper web 73 has a tail 72 and the web 73 and tail 72 are scraped off the press roll 71 by a doctor blade 74. In order to thread the prior art tail 72 into a dryer section, a jet of air from a nozzle 75 blows the web against a first dryer fabric 76 which turns around a vacuum roll 78. The tail 72 when it becomes attached to the dryer fabric 76 pulls a streamer 77 formed from a portion of the web 73 consisting of spent tail 80 which has pass down into a broke pit 79. Pulling the streamer 77 into the dryer section on prior part papermaking machines not infrequently resulted in failure of the threading process.

As shown in FIG. 2, in the apparatus of this invention, the paper web 12 after it is cut by the water jet 63 is transferred by the suction pick-up roll 22 onto the first or pickup press felt 20 which transfers the wet paper web 12 from the forming section 14 to the press section 16. The web 12 is directed through the first and second press nips 32, 38 where water is pressed from the web 12. Once pressed against the center press roll 36 at the second press nip 38, the paper web 12 is guided by and along the center press roll 36 through the third press nip 44 and the contact nip 50. The center press roll 36 could alternatively be wrapped by an endless press belt, to assist in pressing and release of the web.

In typical prior art transfers between the pressing section and the drying section, an open draw is formed between the last press roll and the first dryer roll. Thus the paper web is unsupported as it travels from the pressing section to the drying section. Typically this is done to avoid problems with the joint in the dryer felt pressing against the center roll leaving a mark on the paper. However in the present invention, the first drying fabric 48 is of the seamless or low profile joined type. Thus the entire travel of the web 12 from the forming section through at least the dryer section 18 is without an open draw. This constant support of the web 12 in the forming section 14 and pressing section 16 allows the web 12 from which a tail 62 has been cut to travel securely from the forming fabric to the doctor blade 52.

Prior to threading, the doctor blade 52 scrapes the paper web 12 off of the center press roll 36, directing it into a broke pit 54. When threading of the dryer section is to be initiated, air jets 53 direct a flow of air to maneuver the doctored paper web 12 against the vacuum vacuum suction roll 46 and the dryer fabric 48. The web 12 engages the fabric 48, and the fabric engage the vacuum suction roll 46, so that the web 12 will be on the inside of the fabric 48 when the fabric makes contact with the first dryer roll. The cut tail 62 is thus blown to be brought against the vacuum suction roll 46 and threaded into the dryer section 18 along the dryer fabric 48 where it is dried on a series of steam-heated drying cylinders or rolls 66.

The vacuum roll 46 has two suction glands 82, 84. A first gland 82 extends only two to twenty-four inches in the cross machine direction along the roll surface. The first gland 82 is operated by a microprocessor 81 and is adjacent to that portion of the web which forms the tail 62. The first gland 82 is instrumental in attaching the tail to the dryer fabric 48. The first gland 82 normally only supplies suction while the dryer section 18 is being threaded. A second gland 84 extends the entire width of roll 46 and provides support and clamping of the entire web to the dryer fabric. A suction or blow box 86 is positioned over the fabric 48 as it leaves the roll 46 to hold the web 12 onto the fabric 48 as it moves into the dryer section 18.

The microprocessor 81 or machine controller is connected to the carriage 60 and controls the motion of the water jet 63. The microprocessor 81 is also connected to the valve (not shown) which controls the air jets 53 and the valves (not shown) which control the vacuum gland 82 on the vacuum suction roll 46.

The air jets 53 and the vacuum on the vacuum suction roll 46 are timed to engage the blunt end 67 of the tail 62 formed by the pneumatic actuator 65 rapidly moving the water jet 63 from the front edge 56 of the forming fabric 23 to a distance across the web equal to the tail width.

A modern highspeed papermaking machine for lightweight grades of paper may operate at 6,000 feet per minute or faster. This implies an actuation speed for the pneumatic actuator 65 of at least one hundred feet per second. Thus the motion of the water jet 63 from the edge 56 of the forming fabric and of the web 12 towards the center of the web occurs in less than a hundredth of a second.

The blunt end 67 is not directly detected but rather its position is predicted based on an adjustable timing variable which may be manually input or can be calculated from a measurement of machine speed, the distance between the cutter 58 and the doctor blade 52, together with precise timing of the tail 62 formation. By creating a distinct blunt end 67 to the tail 62, and by controlling the air jets 53 and the vacuum roll 46 first gland 8 in concert with the tail cutting operation, it is possible to guide the blunt end of the tail directly into the dryer section with no streamer, hence eliminating a possible cause of jamming within the dryer section.

It should be understood that although the tail cutter 58 is described as being positioned relative to the forming fabric 23 at the forming section 14, it may also be positioned at other locations in the paper machine 10, such as below the paper web 1 disposed on the pick-up felt 20 between the pick-up roll 22 and the press roll 30 in the press section 16.

U.S. Pat. No. 5,087,325 to Page discloses an apparatus and method for forming and threading a tail cut from a paper web on a forming fabric. Page however discloses separating the tail from the remainder of the web before the tail enters the pressing section. When Page describes an alternative embodiment in which the tail is separated from the remainder of the web after the pressing section, it is clear that the tail and remainder are first allowed to become established at the doctor blade. Once the tail and the remainder of the web are flowing into a broke pit, the tail is blown onto a downstream guide roll. This arrangement is substantially the same as that shown in prior art FIG. 1 and would produce a streamer from spent tail pulled from the broke pit.

It should be understood that the expression "No open draw" or "Closed draw" refers to the paper web in a papermaking machine, or a portion of a papermaking machine such as the dryer section, in which the web is substantially supported. Thus where a "closed draw" is used, it means the paper is supported by at least one fabric or roll at all times as it passes through the papermaking machine or section of a papermaking machine. A papermaking machine which has few or no open draws is more easily threaded because the web is at all times in contact with a roll, a fabric, or both which guides the web through the machine.

It should be understood that the term suction roll has developed in the United States in association with rolls used in the forming and pressing section of a papermaking machine where high vacuum measured in inches of mercury is typically employed. The term vacuum roll has been used to describe rolls utilized in the dryer section having substantially lower vacuum levels measured in inches of water. One inch of water as a measure of pressure is more than ten times less pressure then an inch of mercury. The vacuum suction roll 46 described herein generally employs low pressure of about two to about four inches of water. However the vacuum suction roll 46 incorporates first and second suction glands 8, 84 which employ high vacuum typically a few inches of mercury. It is also conventional to measure vacuum as a negative pressure, that is inches of water or inches of mercury below atmosphere pressure.

The air nozzle 53 shown schematically in FIG. 2 may be similar to the air nozzle 75 shown in FIG. 1. Alternatively, as known to those skilled in the art, a closed pipe with multiple holes may be employed. Further a pair of air nozzles known as caliper jets may be used. Caliper jets are positioned above the doctor blade 52 and are positioned to blow air against the edges of the tail 62 to lift the tail off the roll 36 and blow the tail with air deflected off the roll 36 towards the vacuum suction roll 46.

It should be understood that other means than illustrated in FIG. 3 could be used to rapidly form the tail 62. For example a water knife mounted on a pivot to swing along an arc could be used to cut the blunt end of the tail 62. The pivoting water knife could be mounted on the carriage or could be mounted independently of the carriage.

Similarly two water knives could be used: one mounted on the carriage for slowly traversing the web, and one mounted on a piston fixedly mounted at the front of the web. If two water knives are used they would be positioned aligned in the machine direction to cut a continuous tail from the remainder of the web. The piston-mounted knife would then be rapidly moved towards the edge of the web to form a blunt end which would be used to initiate threading of the dryer section.

The advantage of mounting the rapidly traversing water knife and slowly traversing water knife on separate structures is that any dynamic oscillation of the water knife induced by the rapid slowing of the water knife takes place after the water knife leaves the web.

The foregoing wet end tail cutting means for cutting a tail in the paper web operates in such a way that the tail reaches full width in a length approximately equal to the tail width, for example, generally a length which is less than about two or three times the width, and preferably less than the width.

It is understood that the invention is not limited to the particular construction and arrangement of parts herein illustrated and described, but embraces such modified forms thereof as come within the scope of the following claims.

I claim:

1. A papermaking machine comprising;

at least one forming fabric on which a paper web is formed;

a pressing section having at least one press and being without open draws, in web receiving relationship with the forming fabric so the paper web is transferred between the forming fabric and the pressing section without an open draw;

a carriage mounted to move in a cross machine direction across the paper web, before the web reaches the at least one press of the pressing section;

a low pressure water jet positioned on the carriage and directed towards the web, wherein the water jet is movable rapidly in the cross machine direction with respect to the web to cut from the web a tail with a blunt tail end;

a dryer section without open draws having a vacuum suction roll positioned to receive the web from the pressing section; and a controller which controls the vacuum suction roll to actuate the vacuum suction roll in response to the cutting of the tail, to transfer the tail of the paper web from the pressing section to the dryer section when the blunt tail end first reaches the vacuum suction roll.

2. The apparatus of claim 1 further comprising an air jet mounted between the dryer section and the pressing section for blowing the tail of the paper web against the vacuum suction roll, wherein the controller controls the air jets, to actuate the air jets in response to the cutting of the tail, to transfer the tail of the paper web when the blunt tail end first reaches the vacuum suction roll.

3. The apparatus of claim 1 wherein the water jet is mounted on a pneumatic cylinder which is mounted on the carriage so that the pneumatic cylinder provides rapid cross machine direction displacement of about 2 to about 12 inches for rapidly cutting a tail.

4. The apparatus of claim 1 wherein the carriage is mounted over the forming wire.

5. The apparatus of claim 1 wherein the pressing section has a pickup felt and the carriage is located under the pickup felt.

6. The apparatus of claim 1 wherein the dryer section includes at least a single tier of dryers.

7. The apparatus of claim 1 wherein the pressing section has a press roll and at least one backing roll forming a press nip thereon and wherein a doctor blade is positioned to doctor the press roll after the press nip and wherein the air jet is positioned adjacent to the doctor blade to blow a tail passing over the doctor blade onto the vacuum suction roll.

8. The apparatus of claim 1 wherein the vacuum suction roll has a suction gland which extends about 2 to about 24 inches in a cross machine direction from an edge of a portion of the roll surface where the web is supported, and wherein the controller is in controlling relation with the suction gland to cause the gland to operate when the beginning of the web reaches the vacuum suction roll.

9. The apparatus of claim 1 further comprising means for moving the web cutting means in a cross machine direction with respect to the web at a velocity which is approximately the velocity of the web in the machine direction.

10. A papermaking machine comprising;

at least one forming fabric on which a paper web is formed;

a pressing section having at least one press and being without open draws, and in web receiving relationship with the forming fabric so the paper web is transferred between the forming fabric and the pressing section without an open draw;

a carriage mounted to move in a cross machine direction across the paper web, before the web reaches the at least one press of the pressing section;

a web cutting means positioned on the carriage and directed towards the web, wherein the web cutting means is mounted for rapid motion in a cross machine direction to cut a paper web tail having a blunt end;

a dryer section without open draws having a vacuum suction roll positioned to receive the web from the pressing section;

a means for facilitating the transfer of the tail from the pressing section to the dryer section mounted between the dryer section and the pressing section; and a means for controlling the vacuum suction roll and the means for facilitating the transfer of the tail, the means for controlling being responsive to the cutting of the paper web tail by the web cutting means to activate the means for facilitating the transfer of the tail when the blunt end of the tail first reaches the means for facilitating the transfer of the tail.

11. The apparatus of claim 10 wherein the web cutting means is mounted on a pneumatic cylinder which is mounted on the carriage so that the pneumatic cylinder provides rapid cross machine direction displacement of about 2 to about 12 inches for rapidly cutting a tail.

12. The apparatus of claim 10 further comprising means for moving the web cutting means in a cross machine direction with respect to the web at a velocity which is approximately the velocity of the web in the machine direction.

13. The apparatus of claim 10 wherein the dryer section comprises a single tier of dryers.

14. The apparatus of claim 10 wherein the pressing section has a press roll and at least one backing roll forming a press nip thereon and wherein a doctor blade is positioned to doctor the press roll after the press nip and wherein the means for facilitating the transfer of the web is positioned adjacent to the doctor blade to blow a tail passing over the doctor blade onto the vacuum suction roll.

15. The apparatus of claim 10 wherein the vacuum suction roll has a suction gland which extends about 2 to about 24 inches in a cross machine direction from an edge of a portion of the roll surface where the web is supported, and wherein the means for controlling is in controlling relation with the suction gland to cause the gland to operate when the web tail end makes contact with the vacuum suction roll.

16. A papermaking machine comprising:

a forming section with a forming fabric having a paper web disposed thereon;

a closed draw pressing section engaged with the forming fabric, wherein the pressing section has a pick-up felt extending as an endless loop and receiving the paper web from the forming fabric;

a closed draw suction pick-up roll disposed within the loop defined by the pick-up felt such that the pick-up felt is guided by and around the suction pick-up roll;

a first suction press roll disposed within the loop defined by the pick-up felt;

a first press felt extending as an endless loop having a first backing roll located therein, the first backing roll cooperating with the suction press roll such that the pick-up felt and the press felt extend through a first press nip defined between the first suction press roll and the first backing roll;

a second backing roll disposed within the loop defined by the pick-up felt, the second backing roll cooperating with a center press roll such that the pick-up felt extends through a second press nip disposed downstream relative to the first press nip, the second press nip defined between the center press roll and the second backing roll;

a second press felt extending in an endless closed loop, having a third backing roll disposed within the second press felt loop such that the second press felt is guided by and against the third backing roll, the third backing roll cooperating with the center press roll such that the second press felt extends through a third press nip disposed downstream relative to the second press nip, the third press nip defined between the center press roll and the third backing roll;

a dryer section downstream of the press section, the dryer section having a vacuum suction roll disposed within an endless loop formed by a dryer fabric, the vacuum suction roll located in nipped contact with the center press roll such that a tail with an end on the paper web is guided to the dryer section by the vacuum suction roll;

a plurality of vacuum rolls disposed within the dryer section downstream relative to the vacuum suction roll;

a wet end tail cutting means for cutting a tail in the paper web in such a way that the tail reaches full width in a length approximately equal to the tail width;

a doctor for doctoring the paper web from the center press roll, the doctor located beneath the vacuum suction roll;

an air jet positioned to direct a flow of air to direct the doctored paper tail against the dryer fabric and vacuum suction roll; and a controller which synchronizes the traversing of the wet end tail cutter with the activation of the air jet to thread the paper web tail into the dryer section.

17. The papermaking machine of claim 16 wherein the cutting means is positioned on a carriage traversing means which moves the wet end tail cutter means across the moving paper web in the cross machine direction at an average speed approximately equal to the machine speed.

18. The papermaking machine of claim 16 wherein the wet end tail cutter means is positioned below the paper web disposed on the pickup felt.

19. The papermaking machine of claim 16 wherein the dryer section has a plurality of dryer rolls defining a plurality of pairs of dryer rolls, and wherein a reversing vacuum roll is positioned between each pair of dryer rolls.

20. A method of threading a paper web through a papermaking machine, which comprises:

transferring a paper web from a forming fabric onto a press felt without an open draw, passing the web and press felt through at least one nip in a press section, and threading the paper web into a dryer section, the press section having a final press roll defining a roll surface and a final press nip with at least one air jet positioned relative to a doctoring blade for doctoring the paper web off of the final press surface, the dryer section having a vacuum suction roll in contact with the final press roll surface for guiding the doctored paper web against a dryer fabric for threading into the dryer section;

traversing a wet end tail cutter, positioned before the final press nip, across the moving web in the cross-machine direction at a rate of speed approximately equal to or greater than the rate of speed of the moving web to form a blunt tail end; and energizing the vacuum suction roll and plurality at least one air jet positioned at the doctoring means in synchronization with the cutting of the blunt tail end, such that the air jets and vacuum suction rolls are engaged approximately simultaneous with passage of the blunt tail end over the doctor blade, to thread the tail into the dryer section without a streamer.

21. The method of claim 20 wherein the wet end tail cutter is positioned above the paper web as it travels towards the pressing section on the forming fabric.

22. The method of claim 20 wherein the paper web is transferred using a closed draw suction pick-up means.

23. The method of claim 20 wherein the dryer section has a plurality of dryer rolls defining a plurality of pairs of dryer rolls and wherein a reversing vacuum roll is positioned between each pair of dryer rolls.

* * * * *